US005964525A

United States Patent [19]

Albou

[11] Patent Number: 5,964,525

[45] Date of Patent: Oct. 12, 1999

[54] SIDE LAMP DISPLAY OR INDICATING LIGHT HAVING AN INTERMEDIATE SCREEN, AND A METHOD OF MAKING SUCH A SCREEN

[75] Inventor: Pierre Albou, Paris, France

[73] Assignee: Valeo Vision, France

[21] Appl. No.: 08/780,882

[22] Filed: Jan. 9, 1997

[30] Foreign Application Priority Data

Jan. 10, 1996 [FR] France ..... 96.00196

[51] Int. Cl.[6] ..... F21V 5/00

[52] U.S. Cl. ..... 362/522; 362/333; 362/331

[58] Field of Search ..... 362/333, 61, 80, 362/328, 331, 332, 339, 293, 243, 520, 522

[56] References Cited

U.S. PATENT DOCUMENTS

| | | | |
|---|---|---|---|
| 3,764,800 | 10/1973 | Closterman | 362/333 |
| 4,118,853 | 10/1978 | Mignen | 29/424 |
| 4,538,216 | 8/1985 | Mori et al. | 362/333 |
| 4,542,448 | 9/1985 | Yamai et al. | 362/331 |
| 4,644,455 | 2/1987 | Inglis et al. | 362/331 |
| 4,656,567 | 4/1987 | Morris | 362/293 |
| 4,670,823 | 6/1987 | Kochi et al. | 362/331 |
| 4,835,666 | 5/1989 | Feger et al. | 362/293 |
| 4,868,725 | 9/1989 | Sakagawa et al. | 362/243 |
| 5,161,885 | 11/1992 | Segaud et al. | 362/333 |
| 5,436,762 | 7/1995 | Duneau | 362/333 |
| 5,515,253 | 5/1996 | Sjobom | 362/333 |
| 5,584,570 | 12/1996 | Binder et al. | 362/333 |
| 5,603,561 | 2/1997 | Ohishi | 362/331 |
| 5,658,072 | 8/1997 | Natsume et al. | 362/332 |

FOREIGN PATENT DOCUMENTS

| | | |
|---|---|---|
| 0 678 702 | 10/1995 | European Pat. Off. . |
| 85 33 666 | 1/1986 | Germany . |

*Primary Examiner*—Laura K. Tso
*Attorney, Agent, or Firm*—Morgan & Finnegan, LLP

[57] ABSTRACT

An indicating light or side lamp display for a motor vehicle comprises a substantially point light source, a flux recuperator such as a mirror, for reflecting the light from the source towards the outside in the form of an essentially parallel beam, and, interposed in the path of the beam, an intermediate screen and a cover lens. The intermediate screen has a set of optical cells, each of which includes on an internal face a substantially spherical surface for spreading the light, and, on an outer face of the screen, a set of at least two flat facets which are oblique with respect to the plane of the intermediate screen.

23 Claims, 2 Drawing Sheets

SIDE LAMP DISPLAY OR INDICATING LIGHT HAVING AN INTERMEDIATE SCREEN, AND A METHOD OF MAKING SUCH A SCREEN

FIELD OF THE INVENTION

The present invention relates in general terms to side lamp displays for motor vehicles, and the like, more particularly to a side lamp display that includes indicating lights for giving indications for various purposes to persons outside the vehicle referred to generally in this specification as an indicating light.

More specifically, the invention relates to an indicating light for a motor vehicle. The indicating light has a substantially point source, a flux recuperator for transmitting towards the outside an essentially parallel beam, an intermediate screen, and a cover lens, the intermediate screen and cover lens being interposed in the path of the essentially parallel beam.

BACKGROUND OF THE INVENTION

In known indicating lights of the above type, the intermediate screen, and also where appropriate the cover lens, include optical configurations which are adapted to give to the indicating light the desired photometry and, sometimes, a particular appearance or aspect in terms of style.

DISCUSSION OF THE INVENTION

An object of the present invention is to provide a side lamp display or indicating light of the above type which, while satisfying the various regulations as regards photometry, also has a novel visual aspect when extinguished as well as when illuminated.

More precisely, the invention aims to provide an indicating light which, when extinguished, has a certain brilliance by favouring penetration of incident light into the display itself, and in particular incident light coming from above (such as sunlight), and which then re-emits that light in a way that is somewhat similar to faceted precious stones.

A further object of the invention is to provide a sidelamp display or indicating light which, when lit (illuminated) gives the impression of including a plurality of individual elementary light sources, in the same way as indicating lights that have a set of light emitting diodes, and to provide this appearance over a whole range of observation angles.

According to the invention in a first aspect, an indicating light for a motor vehicle has a substantially point source, a flux recuperator for transmitting towards the outside an essentially parallel beam, an intermediate screen, and a cover lens. The intermediate screen is interposed in the path of the essentially parallel beam, and is characterised by a set of optical cells. Each of the cells has, on an internal face, a substantially spherical surface for spreading the light, and each cell has on an outer face a set of at least two flat facets which are oblique with respect to a plane of the intermediate screen.

Preferably, each cell is defined by a substantially spherical surface and by a set of facets associated therewith, the cells defining dimensions or a horizontal pitch and a vertical pitch in the approximate range 5 to 30 mm.

The substantially spherical surfaces are preferably convex.

Preferably, the facets in each set are hollow.

The facets in each set are preferably bounded laterally by cut-off facets which are slightly inclined with respect to the direction of the parallel beam.

Preferably, the facets are joined together along horizontal lines.

Each set of facets may consist of two oblique facets which are symmetrical with respect to a median line of the corresponding cell.

Alternatively, each set of facets may consist of a central facet extending substantially at right angles to the direction of the parallel beam, together with two oblique facets lying on either side of the central facet, the oblique facets being symmetrical with respect to a median line of the corresponding cell.

Again, each set of facets may consist of a pair of oblique central facets, together with a pair of external facets orientated more obliquely.

According to a preferred feature of the invention, the obliquity of the facets is determined to correct the spread provided by the corresponding substantially spherical surface, either only in the vertical direction, or only in the horizontal direction. Thus the screen by itself provides a horizontal spread and a vertical spread, in accordance with regulations and different from each other.

Preferably, the cover lens is smooth on both its faces and lies substantially parallel to the intermediate screen.

According to the invention in a second aspect, a method is provided for making an intermediate screen for a side lamp display or indicating light for a motor vehicle. The screen cooperates with a substantially point light source and with a flux recuperating means that produces an essentially parallel light beam in which the screen is to be interposed. The indicating light is adapted to provide illumination over a given horizontal angular field and vertical angular field, characterised in that the method includes the steps of:

designing a generally spherical elementary surface which, being formed on a zone of the inner face of the screen, provides deflection for the light covering one of the two angular fields;

designing a set of flat facets which, being formed on the outer face of the screen in line with the generally spherical elementary surface, provide deflection for the light covering the other angular field;

forming a mold having a set of generally spherical elementary surfaces on a first half of the mold and a homologous series of the set of flat facets on the other half of the mold; and molding the intermediate screen using the mold.

Further features and advantages of the present invention will appear more clearly on a reading of the following detailed description of some preferred embodiments of the invention, which is given by way of non-limiting example only and with reference to the accompanying drawings.

DESCRIPTION OF PREFERRED EMBODIMENTS OF THE INVENTION

Figure 1:
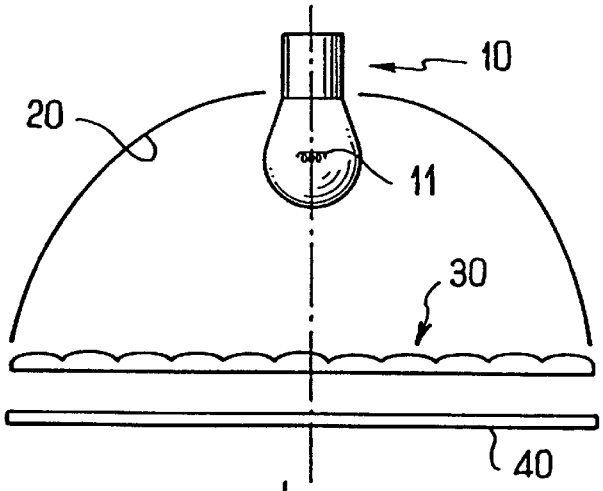
FIG. 1 is a view in horizontal axial cross section of a side lamp display or indicating light in accordance with the present invention.

It should be noted at the outset that, as between one Figure and another in the drawings, those elements or parts which are identical or similar to each other are designated, as far as possible, by the same reference signs.

Reference is first made to FIG. 1, which shows a side lamp display or indicating light which comprises a light source 10, a flux recuperator, an intermediate screen 30, and a cover lens 40. The light source 10 is typically a filament lamp 11, while in this example the flux recuperator consists of a parabolic mirror 20 focused on the filament 11 and formed on the base or body of the indicating light. The lens 40 is preferably smooth or flat on both faces, and may be parallel to the intermediate screen 30, or otherwise.

In the present example the screen 30 and the lens 40 lie in planes which are essentially at right angles to the general direction of the incident beam which is defined by the major axis of the parabola of the mirror 20. However, it will be understood that curved forms may also be envisaged for the screen 30 and lens 40.

Figure 2:
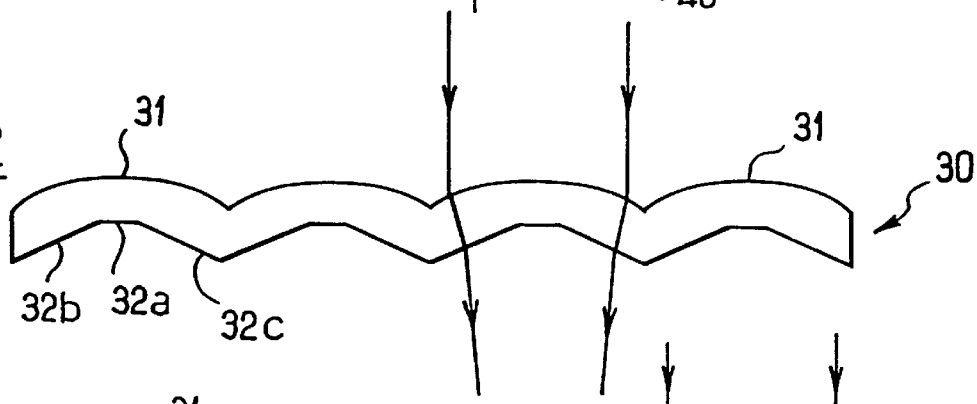
FIG. 2 is a partial view in vertical cross section, on an enlarged scale, showing an intermediate screen of the indicating light of FIG. 1.
Figure 3:
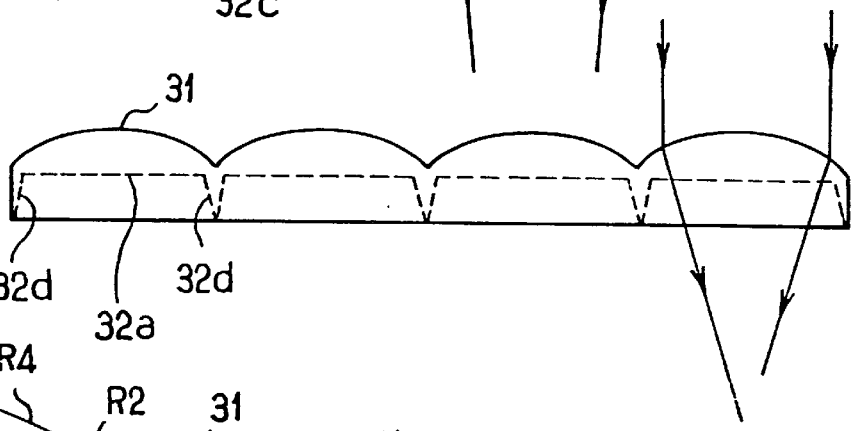
FIG. 3 is a partial view of the intermediate screen in horizontal cross section and rotated 90° with respect to the FIG. 2 cross section.

Reference is now made more particularly to FIGS. 2 and 3, in which the intermediate screen has, on its inner or internal face, a plurality of surfaces in the form of portions of convex spheres 31, which are inscribed within rectangular parallelepipeds (the latter being squares in this example); these convex surfaces partly define individual optical cells or dioptnes.

As will be seen more clearly later in this document, in order to give the indicating light, when illuminated, a marked "multi-source" aspect, the size of the cells is substantially larger than that of the balls or toroidal elements conventionally employed in intermediate screens or cover lenses. Thus, whereas these optical elements of known types generally have a side length of the order of 2 to 4 mm, those in embodiments of the present invention have a size which is preferably selected within the range 5 to 30 mm.

The radius of each sphere, and the size of the cell, are selected in this example in such a way as to give them at least the minimum angular deviation in the horizontal or vertical direction imposed by photometric regulations. For example, if a regulation requires that the horizontal spread of the radiation should be within a range of ±20° with the vertical spread in the range ±10°, the surfaces 31 are then so chosen as to provide at least the ±20° deviation.

In the case where the cells are square, and for a perfectly spherical surface, or more generally a surface of revolution, it will be understood that the same spread is also provided in the vertical direction. In order to bring this vertical spread to the required value, in this example ±10°, there is provided on the outer face of the intermediate screen, in association with each spherical surface 31, a set of facets which extend parallel to a horizontal straight line which lies at right angles to the optical axis of the indicating light.

In this example, three surfaces or facets are provided, namely a central facet 32*a* at right angles to the optical axis, an upper facet 32*b*, and a lower facet 32*c*. The upper and lower facets are inclined, preferably symmetrically, in such a way that the three facets together define a hollow surface.

The object of the central facet 32*a* is to avoid vertical deflection of the light, in order mainly to leave a sufficient quantity of light in the emission axis. The purpose of the upper and lower facets 32*b* and 32*c* is to attenuate the vertical deflection of the light radiation which is provided by the associated sphere 31.

Figure 4:
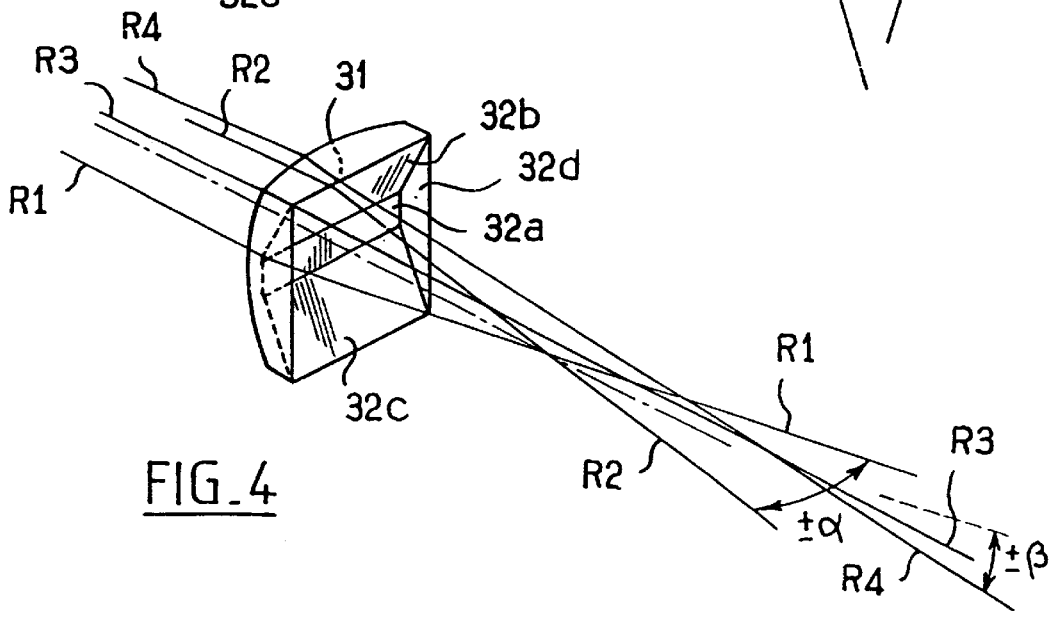
FIG. 4 is a perspective view which shows the optical behaviour of one cell of the indicating light seen in FIGS. 1 to 3.

Thus, as shown in FIG. 4 to which reference is now made, two rays R1 and R2, situated at the same height and intersecting the cell in the vicinity of its side edges, become deflected laterally, mainly by the spherical surface 31 so as to obtain a spread of $\pm\alpha$, which is the required spread. By contrast, two rays R3 and R4, lying one above the other and intersecting the cell in the vicinity of the upper and lower edges of an inclined facet 32*b* or 32*c*, become, firstly, deflected vertically in an excessive way by the spherical surface 31, and are then redirected by an appropriate amount by the same facet, in such a way that the required vertical spread is finally obtained.

The inclination of the facets 32*b*, 32*c* is of course determined (by calculation or experiment) mainly in accordance with the foregoing.

In this example, the cover lens 40 is smooth on both its faces, and therefore plays no part in the optics involved; nor does it affect the aspect given by the indicating light.

If the indicating light is to emit coloured light, the colour is preferably given either by the bulb of the lamp, or by a coloured globe surrounding the lamp, or by the intermediate screen being appropriately coloured, or again by the cover lens 40.

The indicating light described above has a certain number of advantages, both when it is lit and when it is extinguished. First of all, when the light is lit (illuminated), the combination of each spherical surface and the associated flat facets gives rise to the provision of a plurality of secondary real sources, all having similar intensities and remaining visible over a large angular field. This creates the illusion of a multi-lamp indicating light, such as a light of the kind having light emitting diodes. In addition, when the observer moves in front of the indicating light, all of these secondary sources are displaced in the same way, and retain their similar intensities, and this reinforces the above mentioned illusion.

When the indicating light is extinguished and observed under conditions of light from above, such as sunlight, the lower inclined facets 32*c* define, with the general direction of the radiation, an angle which is closer to 90° than it would be if these facets were vertical. As a result, a greater proportion of the incident light penetrates into the indicating light, and is then returned to the outside by the mirror 20. This gives the indicating light a brilliant aspect, or in other words a somewhat striking effect. In addition, the regular character of the configurations on the outer face of the intermediate screen gives the light, in conjunction with this striking appearance, the same kind of appearance as that of a faceted precious stone, which is important in terms of style because it represents a radical departure from the objectives normally looked for in this field.

It will be observed in FIGS. 3 and 4 that each set of facets arranged to define a recess associated with a spherical surface is bounded laterally by two slightly oblique cut-off surfaces 32*d*, which also contribute, through the acute angles defined by pairs of these surfaces 32*d*, to the precious-stone effect mentioned above.

Figure 5:
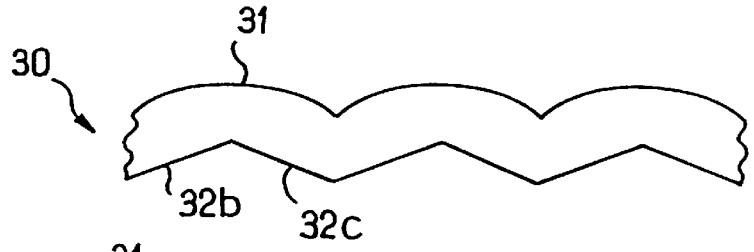
FIG. 5 is a partial view in vertical cross section of an intermediate screen in accordance with a first modified embodiment of the invention.

Reference is now made to FIG. 5 showing a first modified embodiment of the invention, In FIG. 5, the internal face of the screen 30 is unchanged, However, there are no longer three facets associated with each of the individual spherical surfaces 31, but only two facets 32*b*, 32*c*, which are oblique and symmetrical, This embodiment is applicable in particular when there is no need to preserve a high proportion of light in the axis of the indicating light by providing the central facet 32*a*.

Figure 6:
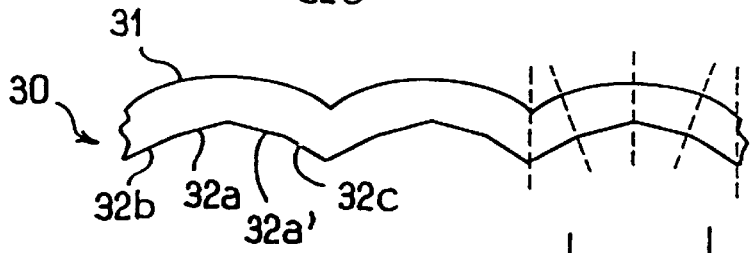
FIG. 6 is a partial view in vertical cross section of an intermediate screen in a second modified embodiment of the invention.

In the second modified embodiment shown in FIG. 6, to which reference is now made, each cell of the intermediate screen 30 has four facets on its outer face, namely two central facets 32*a*, 32*a'* which are slightly inclined with respect to the plane of the screen 30, together with two outer facets. These outer facets consist of an upper facet 32*b* and a lower facet 32*c*, which are more steeply inclined than the central facets. This version is well adapted in particular to the kind of photometry required in reversing lights by the regulations.

It should be observed here that, in all cases, the facets are preferably joined together with first order continuity, that is to say there does not exist any hollow or step between them.

Figure 7:
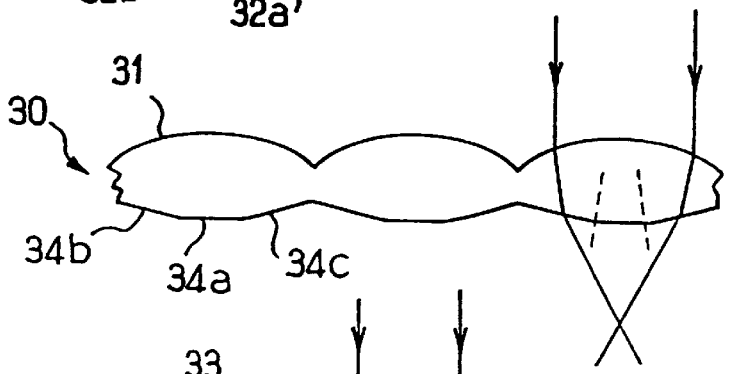
FIG. 7 is a partial view in horizontal cross section of an intermediate screen in a third modified embodiment of the invention.

Reference is now made to FIG. 7 showing yet another version, in which the facets 34*a*, 34*b* and 34 *c* provided on the outer side of the intermediate screen 30 are no longer hollow. Instead, they project from the screen. This version is applicable in particular when it is desired to use these facets to increase the light spread which is provided initially by the associated spherical surfaces 31. For example, an elementary spherical surface 31 can be so designed as to provide a spread of ±10° in both the horizontal and vertical directions. The facets are used in this case to increase the horizontal spread, so that it can for example reach ±20°. This is why, in this case, the screen is shown in FIG. 7 in horizontal cross section.

Figure 8:
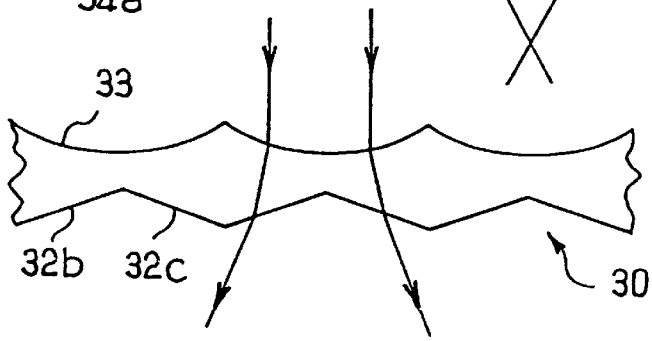
FIG. 8 is a partial view in horizontal cross section of an intermediate screen in a fourth modified embodiment of the invention.

Reference is now made to FIG. 8, which shows a further version in which the convex spheres 31 featured in the embodiments already described are replaced by concave spherical surfaces. As a result, the radiation which passes through these cells (or dioptres) is no longer convergent but divergent. The associated external facets do however have the same function, namely that of correcting the vertical, or preferably horizontal, spread given by the associated spherical surface.

It should be noted here that in this case, the secondary sources that are created are no longer real sources situated on the outside of the intermediate screen 30, but are instead virtual sources situated on the inner side of the screen. The effect obtained, in terms of the impression given of a multi-source indicating light, remains satisfactory in this case.

Figure 9:
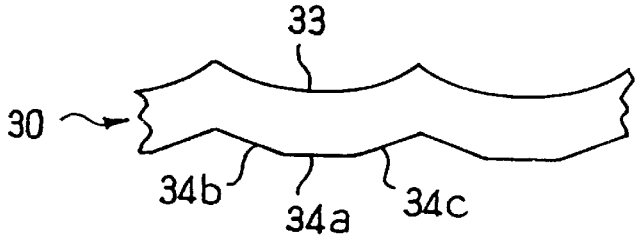
FIG. 9 is a partial view in vertical cross section of an intermediate screen in a fifth modified embodiment of the invention.

Referring now to FIG. 9, the version shown in this Figure is that of an intermediate screen in which the spherical surfaces are concave (given by the reference numeral 33), and the inclined facets, 34*a*, 34*b* and 34*c* which are similar as to their distribution with those in FIG. 2, project from the screen. Also in this case, the effect obtained is the same, namely that the spherical surfaces provide a suitable spread in one direction, while the combination of the spherical surfaces and the facets provide a suitable spread in the other direction.

Figure 10:
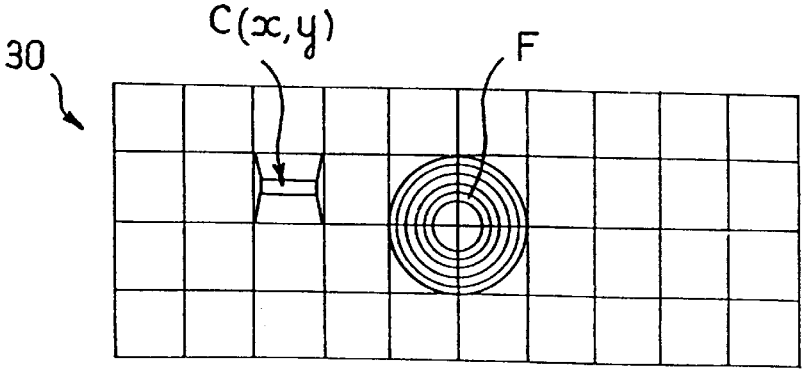
FIG. 10 is a front view of an intermediate screen in a further modified embodiment of the invention.

FIG. 10 shows yet another embodiment of the intermediate screen. The screen in this case is adapted to take account of the direct light emitted by the lamp 10 towards the intermediate screen. Thus, the screen 30 in this case has a Fresnel lens F on its internal face, while the sets of facets are retained on the outer face, as indicated for example by the cells C $(_{x,\ y})$. Each of these cells consists of a spherical surface 31 and an associated set of facets as described above. Instead of the Fresnel lens, spheres similar to the spheres 31 can be used if desired, but with the surfaces of these spheres being corrected in order to take account, firstly of the divergence proper to the direct radiation and secondly, its obliquity, which varies from one cell to another.

In yet another version, not shown, the parabolic mirror 20 of FIG. 1 can be replaced by a striated mirror of a kind known per se and capable of behaving in a manner similar to a parabolic mirror while having a reduced depth. In that case, it is possible with advantage to arrange that the striations, which are generally vertical, have the same pitch as the horizontal pitch of the cells of the intermediate screen 30 shown in FIG. 10.

The present invention is of course in no way limited to the embodiments described above and shown in the drawings, and the person familiar with the art will be able to apply any variant or modification to those embodiments which conforms with the spirit of the invention.

What is claimed is:

1. An indicating light for a motor vehicle comprising:

a substantially point light source;

a flux recuperator associated with the light source for reflecting light from the source in an outward direction and in an essentially parallel beam path;

a transparent intermediate screen interposed in front of the light source and recuperator in the beam path; and a cover lens in front of the intermediate screen in the beam path, wherein the intermediate screen has an inner face and an outer face and defines a general plane having a horizontal axis and a vertical axis, the intermediate screen further including a plurality of optical cells, each of the cells having a substantially spherical surface of the inner face for spreading the beam in at least two dimensions, and a plurality of flat facet surfaces on the outer face, at least one of the surfaces being oblique with respect to the plane and wherein each of the surfaces have edges which are substanially parallel to the horizontal axis or the vertical axis.

2. The indicating light of claim 1, wherein the cells each define two dimensions, each of the dimensions being in the approximate range 5 to 30 mm.

3. The indicating light of claim 1, wherein the substantially spherical surfaces are convex relative to the outer face facets.

4. The indicating light of claim 1, wherein the facet surfaces of each of the cells define a recess in the outer face.

5. The indicating light of claim 4, wherein the intermediate screen further includes cut-off surfaces flanking the flat facet surfaces of each of the cells, the cut-off surfaces being oblique with respect to the direction of the beam.

6. The indicating light of claim 1, wherein the intermediate screen defines a plurality of edges joining the facet surfaces of each of the cells.

7. The indicating light of claim 1, wherein each cell defines a median line thereof, and includes two oblique facet surfaces symmetrical with respect to the median line of the cell.

8. The indicating light of claim 7, further comprising:

a central surface lying substantially at right angles to the beam, and with the two oblique facet surfaces on either side of the central surface.

9. The indicating light of claim 1, wherein each of the surfaces are oblique with respect to the plane, and wherein the facet surfaces of each of the cells comprise a pair of oblique central facet surfaces, and a pair of outer surfaces flanking the central surfaces and defining a greater degree of obliquity than the central surfaces.

10. The indicating light of claim 1, wherein the intermediate screen defines, in each cell, an obliquity of the flat facet surfaces of that cell to correct the light beam spread from the corresponding substantially spherical surface in only one of the two dimensions, to enable the intermediate screen to provide the spread in one of the dimensions and a different spread in another of the dimensions.

11. The indicating light of claim 1, wherein the cover lens is flat on both faces and is substantially parallel to the intermediate screen.

12. A method of making a transparent intermediate screen for an indicating light for a motor vehicle, the screen defining a horizontal axis and a vertical axis, the indicating light having a substantially point light source and a flux recuperating means associated with the light source for reflecting light from the source whereby to produce an essentially parallel light beam, the screen being interposed in the beam, the indicating light defining an angular field of illumination and another angular field of illumination generally perpendicular thereto, wherein the method comprises the steps of:

providing on a zone of an inner face of the screen a generally spherical elementary surface for deflecting the light over one field;

providing on an outer face of the screen, and in line with the generally spherical surface, a plurality of flat surfaces for diverting the beam over the other of the angular fields, each of the surfaces have edges which are parallel to the horizontal axis, and at least one of the surfaces being oblique with respect to the plane;

forming a mold having two half molds, with a set of generally spherical elementary surfaces on one of the half molds and a plurality of surfaces homologous with the flat facet surfaces on the other half mold; and molding the screen using the mold.

13. A motor vehicle comprising the indicating light of claim 1.

14. An indicating light for a motor vehicle comprising:

a substantially point light source for generating light;

a flux recuperator associated with the light source for reflecting light from the source in an outward direction and in an essentially parallel beam path;

a transparent intermediate screen interposed in front of the light source and recuperator in the beam path, the intermediate screen having an inner face and an outer face and defining a general plane, the intermediate screen including a plurality of optical cells, each of the cells having a substantially spherical surface of the inner face for spreading the light beam, and a plurality of centrically assymetrical flat facet surfaces on the outer face, at least one of the surfaces being oblique with respect to the plane; and a cover lens disposed to receive the light beam after it passes through the intermediate screen.

15. The indicating light of claim 14, wherein the intermediate screen defines, in each cell, an obliquity of the flat facet surfaces of that cell to alter the spread of the beam received from the corresponding substantially spherical surface to provide a spread in one of dimension that differs from a spread in other dimension.

16. The indicating light of claim 14, wherein the substantially spherical surfaces are convex relative to the facet surfaces of the outer face.

17. The indicating light of claim 14, wherein the cover lens is flat on both faces and is substantially parallel to the intermediate screen.

18. A transparent screen having an inner face and an outer face and defining a plane having a horizontal axis and a vertical axis, the inner surface being disposed to receive an essentially parallel beam of light and transmit an optically altered beam, the screen comprising a plurality of optical cells, each said cell having (1) a substantially spherical surface on the inner face adapted to spread the beam in at least two dimensions and (2) a plurality of flat facet surfaces on the outer face, each of the surfaces have edges which are parallel to the horizontal axis or the vertical axis, and at least one of the surfaces being oblique with respect to the plane of the screen.

19. The screen of claim 18, wherein the flat facet surfaces comprise:

a central surface lying substantially at right angles to the beam; and at least two flanking surfaces on either side of the central surface, the flanking surfaces being oblique with respect to the plane and being symmetrical with respect to a median line defined by the cell.

20. The screen of claim 18, wherein the flat facet surfaces comprise:

a pair of central surfaces lying obliquely with respect to the plane; and at least two outer surfaces flanking the central surfaces, the flanking surfaces defining a greater degree of obliquity than the central surfaces.

21. The screen of claim 18, wherein, in each of the cells, the oblique surface is adapted to alter the spread of the beam received from the substantially spherical surface to provide a spread in one dimension that differs from a spread in another dimension.

22. A transparent screen having an inner face and an outer face and defining a plane, the inner surface being disposed to receive a beam of light, the screen comprising a plurality of optical cells, each said cell having (1) a substantially spherical surface on the inner face adapted to spread the beam in at least two dimensions and (2) a plurality of centrically asymmetrical flat facet surfaces on the outer face, at least one of the surfaces being oblique with respect to the plane.

23. A motor vehicle comprising the indicating light of claim 14.

* * * * *